United States Patent [19]

Woodruff

[11] 4,454,999

[45] Jun. 19, 1984

[54] CABLE DISPENSING DEVICE AND METHOD

[76] Inventor: Harold F. Woodruff, Hacienda Heights, Calif.

[21] Appl. No.: 255,898

[22] Filed: Apr. 20, 1981

[51] Int. Cl.[3] ..... B65H 75/40

[52] U.S. Cl. ..... 242/86.5 R; 242/86.7; 254/134.3 FT; 180/74

[58] Field of Search ..... 242/86.7, 86.5 R, 54 R, 242/75.1; 254/134.3 R, 134.3 FT; 180/74

[56] References Cited

U.S. PATENT DOCUMENTS

| | | | |
|---|---|---|---|
| 3,000,588 | 9/1961 | Brady | 242/86.5 R |
| 3,091,413 | 5/1963 | Leithiser | 242/86.7 |
| 3,165,277 | 1/1965 | Nordlof et al. | 242/75.53 |
| 3,202,376 | 8/1965 | Dutro et al. | 242/75.1 |
| 3,400,542 | 9/1968 | Davis | 242/75.1 X |
| 3,596,728 | 8/1971 | Neville | 180/74 |
| 3,788,575 | 1/1974 | Boettcher | 242/86.7 X |
| 3,881,565 | 5/1975 | Parrish | 180/74 |
| 3,912,225 | 10/1975 | Earnheart | 242/86.5 R |
| 4,071,203 | 1/1978 | Sneed et al. | 242/86.7 |
| 4,085,904 | 4/1978 | McElroy | 242/54 R |

*Primary Examiner*—John M. Jillions
*Attorney, Agent, or Firm*—Jeffrey G. Sheldon

[57] ABSTRACT

The cable dispensing device of the present invention has one or more reels with cable wound thereabout rotatably supported upon a mandrel. Drive means are provided for each reel supported on the device. Accordingly to the method of the invention, control means are operative independently to control the torque applied to each of the reels by the drive means to assist in the rotation of the reels and dispensing of cable wound thereabout. Application of a torque to the reels reduces the tension on the cables when pulling the cables through a duct system adapted to house the cables.

20 Claims, 7 Drawing Figures

CABLE DISPENSING DEVICE AND METHOD

BACKGROUND OF THE INVENTION

The present invention is directed to an apparatus and method for dispensing elongated cables into conduits as is required for dispensing electrical cables into underground duct systems.

In the past, electrical power transmission lines were normally supported above the ground by electric poles or towers. The unsightly and potentially dangerous consequences of stringing electrical power lines in this manner occasioned a shift amongst the electric utilities to the dispensing of large quantities of electric power cables in trenches and underground duct systems. Normally, three cables were laid within the trenches and underground duct systems to facilitate the transmission of three phase electrical power.

In U.S. Pat. Nos. 3,788,575, and 3,400,542, apparatus and methods are disclosed to lay cable in trenches wherein a movable assembly supporting a reel having cable wound thereabout had mechanisms to cause rotation of the reel by the application of a torque to the external surface of the reel. These references do not address the substantially more difficult and entirely different problems associated with dispensing cable into underground duct systems from stationary devices.

One method employed by the prior art for dispensing electrical cables into underground duct systems consisted of using three independent reels, each one having a single cable wound thereabout and adapted to be paid out in response to a pulling tension on each cable. A pulling rope was attached to each of the individual cables, thus facilitating the pulling of the cables simultaneously through the underground duct system. Numerous problems arose as a result of this technique. In particular, it was found to be extremely difficult to coordinate dispensing of three cables from three reels simultaneously into an underground duct system. In addition, cumbersome and powerful equipment was necessary to accomplish this technique, even when only one cable was used. In U.S. Pat. Nos. 2,498,834, 2,532,504, 3,363,879, and 4,101,114, apparatus and methods for dispensing cables employing these techniques are described.

Numerous additional problems arose as a result of dispensing cable into underground duct systems as opposed to laying the cable in open trenches. For example, a typical underground duct has an internal diameter of about 4 to 6 inches. The diameter of the cable normally used for the stated purposes is about 1⅜ths inches for 350,000 circular mil cable, and about 1¾ths inches for 750,000 to 1,000,000 circular mil cable. The close tolerances between the underground duct width and the accumulated diameter of the multiple cables when placed within the underground duct system caused severe jamming problems in the dispensing process, thus having a potentially deleterious effect on the integrity of the individual electrical cables.

In addition, when using the previous methods and apparatus for laying heavy cable or wire, it was common to employ two or three individuals to aid in paying out the cable during the dispensing operation. These individuals, in addition to controlling the cable payout, also monitored the reel rotation to assure a continuous cable payout and to protect against the potential deleterious effect of the rotational inertia built up by the reels while dispensing cable. It should be apparent that more individuals were required to monitor reel rotation when multiple reels were utilized to dispense cable. It was similarly found that cables were dispensed at varying speeds, thus causing the individuals monitoring reel rotation to vary the reel speeds to occasion more uniform dispersal of the cables into the underground duct systems.

Utility companies attempted to circumvent the problems associated with laying three independent cables in a trench or in an underground duct system by triplexing cable, wherein three lengths of electrical cable were helically twisted about each other with some form of tying wire disposed about the helically twisted cables to assure that they retain to their combined shape. The three lengths of cable comprising the triplex cable were then fitted into a sleeve and each cable was then individually or in combination attached to a pulling rope. The sleeve was found useful in guiding the triplex cable into the underground duct systems.

There were even greater problems with this particular system. For example, triplexing was extremely expensive, costing about 15 to 20 cents per linear foot. Moreover, there were high pulling forces required to draw the triplex cable through the underground duct systems, thus resulting in broken strands and line discontinuities within the individual cables making up the triplex cable. It was also found that there was a substantial wastage of cable when using the triplex configuration because the leftover cable is of little if any use, due to the difficulties in splicing the triplex cable.

In addition, the reels utilized to support the triplex cable were necessarily much larger due to the increased diameter and stiffness of the triplex cable. This situation caused further problems because there were numerous restrictions with regard to the height and width of reels that could be carried upon trucks using public highways. The maximum length of triplex cable that could be carried on a reel to be transported was about 1,100 feet because of the weight and height restrictions imposed by either federal or state highway regulations.

Since this triplex cable could only be carried in lengths up to about 1,100 feet, when laying the triplex cable, it was necessary to build splicing vaults into the underground duct system to join the 1,100 foot cable sections. These splicing vaults are extremely expensive to construct and install, and they are in themselves a source of line discontinuities and insulation problems.

Furthermore, it is well known that triplex cable is particularly sensitive to applied pulling tensions, which potentially can cause a substantial strain in the individual cables and possible breakage of the strands forming the cable or the helically twisted wire. These pulling tensions may be inadvertently occasioned during the process of dispensing the triplex cable from a reel. For example, a 9-foot supply reel fully loaded with triplex cable weighs approximately 17,000 pounds. The application of a sufficient pulling force to overcome the stationary inertia of these reels will often cause damage to the electrical cables being pulled through the underground ducts. Moreover, once the reel is moving the rotational inertia of the reel may also cause an overpayout of cable, thus slowing down the cable dispensing operation. Lastly, uncontrolled reel rotation has the possibility of damaging the cable payout mechanism and potentially creating a hazard to workers operating the equipment dispensing the cable.

In view of the problems associated with pulling triplex cable through an underground duct system or maintaining a uniform flow of cable, if pulling multiple cables individually through an underground duct system, it is clear that there is a need for a system that allows one or more cables to be dispensed into an underground duct system easily, quickly and inexpensively.

There is a further need for a cable dispensing device and method which illustrates the ability to simultaneously monitor the dispensing of multiple cables into an underground duct system.

There is a further need for a cable dispensing device and method which is operative to selectively apply a torque to the rims of the reels from which cable is dispensed into an underground duct system, wherein the reels are subject to a braking force when no pulling tension exists on the cables.

Lastly, there is a need for a device and method which is capable of introducing a plurality of cables into an underground duct system, wherein the device can be moved to the mouth of the duct system despite the terrain and orientation of the duct system into which the cables are to be dispensed.

SUMMARY OF THE INVENTION

The invention of the present application is directed to an apparatus and method for dispensing electrical cables. The invention is particularly suitable for dispensing electrical cables into an underground duct system in a manner which solves the problems associated with prior art devices and techniques.

To facilitate the dispensing operations, positive unwinding torque is applied to the rims of the cable-carrying reels to assist the pulling force exerted on the cables when drawing them through the underground duct system. The positive torque lessens the pulling force which must be applied to the reels and thereby moderates the tension in the cables.

In the preferred embodiment, a plurality of cable reels having dual opposing rims are mounted on a frame and a plurality of motors driven by a single hydraulic control system are adapted to impart a rotational torque to each reel. According to the method of the invention the torque is applied to each cable reel preferably by a frictional drive wheel attached to a shaft extending from each motor and in contact with a rim of each reel. The torque applied by each of the hydraulic motors is independently adjustable and assists in rotating the cable reels when a pulling tension is placed on the cable. However, the torque applied is insufficient to overcome the friction of the cables in the duct and to push them through the duct in the absence of a pulling force on the cables.

In this embodiment of the invention, the device includes a support section adapted to suspend up to three reels of electrical cable which is paid out during the course of an underground cable laying operation. Preferably the reels are independently, rotatably supported upon a mandrel which is suspended by a mount extending upwardly from the centermost section of the cable dispensing device. The device is independently portable and has a spreader element selectively engageable therewith for directing the cables being pulled from the reels toward a cable guide and into an underground duct system. After passing through the guide the cables are combined to form a pulling head for drawing the cables through the underground duct system.

A plurality of hydraulic motors are pivotably mounted in the lower portion of the support section, each motor having a rubber-tired wheel driven thereby. Each cable reel supported upon the mandrel has an independent hydraulic drive motor and rubber-tired wheel associated therewith. The rubber-tired wheel is held against the rim of the cable reel by a bell-crank assembly which has a biasing spring which facilitates continuous engagement of the rubber-tired wheel with the reel rim independent of the continuity of the periphery of the reel rim. Each motor is controlled by a pressure valve in the hydraulic fluid line which is adjustable to the desired pressure by the operator.

The device includes a central power and control system operated by a control panel mounted in the forwardmost section of the cable dispensing device. Preferably, the motors and control systems are hydraulic, but other equivalent systems, such as pneumatic systems, are within the skill of the art and the scope of the invention. The control panel is preferably separated into two mutually exclusive independent banks. One bank is useful to house pressure valves associated with the hydraulic driven motors to supply torque to the reel rims. The other bank is useful in controlling hydraulic pistons and motors associated with drive wheel mechanisms and a nose wheel assembly to facilitate independent movement of the portable cable dispensing device. As will be appreciated by those skilled in the art, this reel drive system could be entirely separate from the device drive system.

In operating the cable dispensing device of the present invention in accordance with the method of the invention, the required number of cable reels are first rotatably mounted on the device. This may be done on the job site or at any other convenient location. The reels may either have cable already loaded upon them, or they may be loaded with cable while mounted on the device. The device is then placed or driven into position for the cable pulling operations and the ends of the cable are threaded through the cable spreader. A pulling head is formed and the cables are placed in a cable guide located at the mouth of the underground duct system. The pulling head is attached to a pulling cable or rope which has previously been threaded through the duct in accordance with methods known in the art.

The hydraulic drive motors are adjustably situated such that the rubber-tired wheel on the shaft of each motor is biased toward and in frictional contact with one of the rims of each cable reel. According to the method of the invention hydraulic pressure to the motors is adjusted to create a torque which is somewhat less than the torque required to overcome the static frictional force of the reels which would initiate rotation of the reels. In the preferred embodiment, since the cable is relatively stiff the motors will not turn the reels in the absence of the pulling force on the cables. When the cable is in the duct the frictional force required to move the cable through the duct cannot be applied by pushing—only pulling can supply sufficient force. The hydraulic pressure to the motors may be set just below the pressure which causes the drive wheels to spin against the reel rims. After these adjustments, the cable pulling operations commence by applying a pulling force to the pulling rope from the other end of the underground duct system in a manner known in the art. The motors when set as described above apply a rotational force to the reels which reduces the pulling force required to pull the cable through the duct.

The invention of the present application applies a torque at the preselected torque level and the motors simply assist once the pulling tension is supplied to the other end of the pulling rope. It is to be noted that the present invention does not push the cable into the duct but only assists the pulling of the cable through the duct.

If during the course of the cable pulling operation, the synchronization between the pulling and payout of the cable becomes out of phase such that a slack develops in the cable prior to entering the cable guide, the operator of the cable dispensing device only has to vary the hydraulic pressure to the hydraulic driven motors to lower the torque applied to the reel rims. This slows down the reel rotation and thereby reduces the slack in the cables. When the torque applied by the hydraulic motors becomes too great, the drive wheels held against the reel rims begin to rotate faster than the cable reels. The operator, upon observing that there is a loss of driving contact between the rubber-tired wheels and the reel rims, will be able to lower the hydraulic pressure directed to the hydraulic motors. A balanced state between the pulling operation and the torque applied to the cable reels is thus continuously achieved whereby the tension exerted upon the cables being drawn through the underground duct system is substantially reduced.

Means are also provided for braking the cable reels when the pulling operation is completed or interrupted in order to prevent undesirable overpayout of the cable as a result of the rotational momentum of the reels. In the preferred embodiment of the invention, the hydraulic control system is designed so that the operator may alter the hydraulic circuit to convert the drive motors into hydraulic pumps with a preset hydrostatic head. The motors can thus apply a braking force to the rotating cable reels. In the preferred embodiment the hydrostatic pressure head is approximately 275 pounds. It should be apparent, however, that even higher pressures could be utilized depending upon the weight of cable being pulled. The present device also provides the ability to cut down the flow passing through the hydraulic system thus affecting a different pressure being supplied to the hydraulic motors and consequent torque applied to the cable reels.

In the inoperative state, the hydraulic motors could drive the reels thereby unwinding cable. However, in the situation where the reels are loaded, once the cable is threaded through the spreader bar and into the cable guide and flexible tubing coaxial with the underground duct system the cable is extremely stiff. In this state the hydraulic motors and rubber-tired wheels cannot push the cables into the duct system.

As indicated previously, there are also controls on the cable dispensing device of the present invention to actuate oppositely positioned pistons which are adapted to provide engagement with drive wheel mechanisms for independent movement of the cable dispensing device. These drive wheel mechanisms are adapted to provide either forward, backward, or circular movement of the cable dispensing device.

A gas engine mounted upon the cable dispensing device is operative to supply power to the hydraulic pump which provides hydraulic pressure to the hydraulic motors discussed herein, and to actuate the various pistons which result in movement of the cable dispensing device.

The present invention overcomes the problems associated with the prior art triplexing systems and also systems where only a pulling force is exerted, thereby increasing the possibility of a deleterious strain being imparted on the cables as they are drawn through the underground duct system. By the present invention, substantially less operator time is required to accomplish the cable pulling operations and costs are significantly reduced.

Lastly, because separate reels each having a single cable may be driven independent of each other, very long lengths of cable can be pulled through the ducts, thereby reducing the necessity of building splicing vaults which are both expensive and a source of discontinuities within the insulation system surrounding the power lines. Moreover, the method and apparatus of the present invention may be employed in pulling long lengths of cables easily around at least one curved radius without encountering the problems associated with the different distances the cables must travel.

BRIEF DESCRIPTION OF THE DRAWINGS

FIG. 7 is a schematic representation of the cable dispensing device of FIG. 1 and, in particular, the cable reel drive hydraulic motors and associated hydraulic circuitry useful to facilitate the imposition of a positive torque to the cable reels during the dispensing of cable.

DESCRIPTION OF THE PREFERRED EMBODIMENT

A preferred embodiment of the cable dispensing device of the present invention is illustrated in FIGS. 1 through 6, wherein like structures are identified by like numerals. It should be noted that since opposite sides of the cable dispensing device are similar in most respects, only one side will be described in considerable detail and only those structures which are unique to one side or the other will be separately described and identified.

Figure 1:
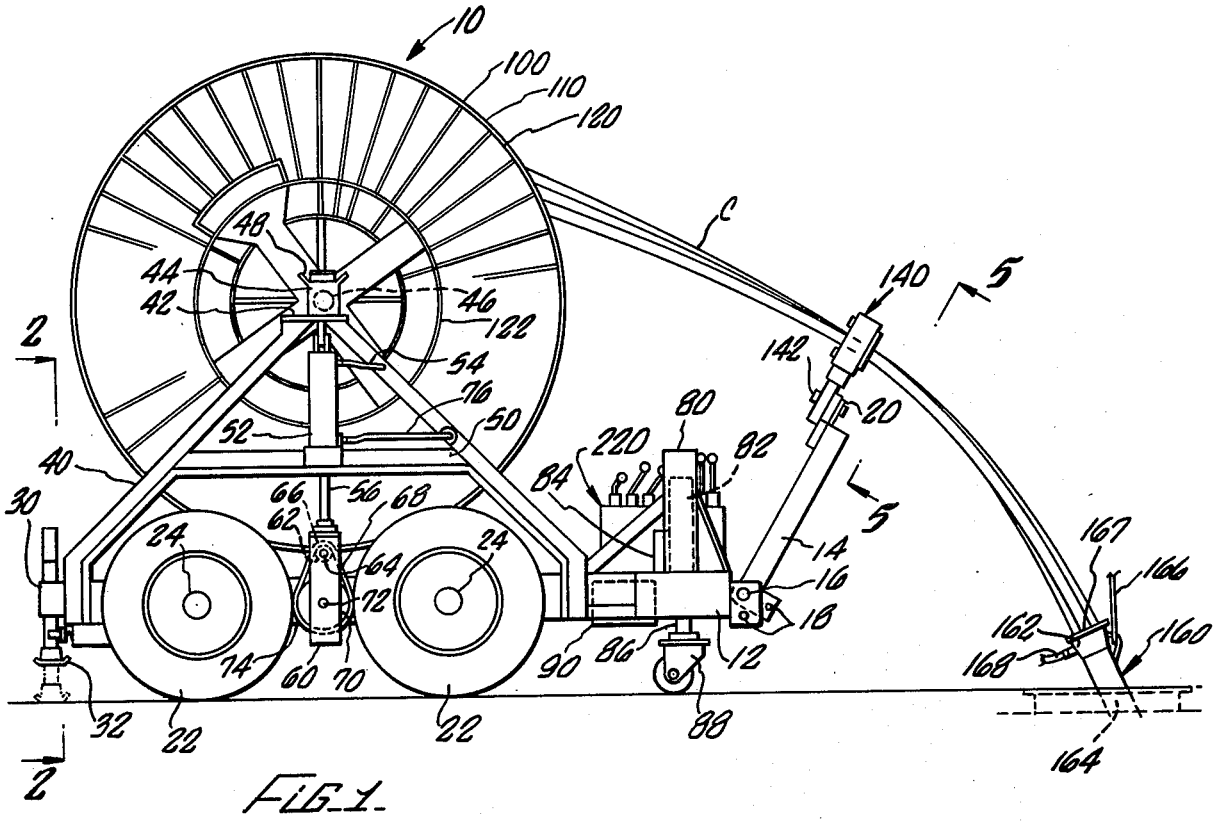
FIG. 1 is a side view of a cable dispensing device according to the present invention illustrating the dispensing of multiple cables in accordance with a preferred embodiment of the present invention which employs a hydraulic control system for the motors.

As illustrated in FIG. 1, the cable dispensing device 10 is designed to be towed by a tractor-type unit or truck (not shown) to the location wherein the electrical cables are to be dispensed into an underground duct system. A frame 12 made of approximately $4\times10\times\frac{3}{8}''$ steel tubing welded at substantially right angles to each other is adapted to support the operative elements of the cable dispensing device 10 as will be described hereinafter. It should be noted that although in the preferred embodiment enclosed steel tubing is designed to be used, other structural elements may be utilized.

The frame 12 has an A-shaped towing tongue 14 rotatably attached thereto at pivot section 16. The tongue 14 and pivot section 16 each have locking apertures 18, which when aligned are adapted to receive a pin (not shown) which is operative to rigidly lock the tongue 14 to the frame 12 when the device 10 is to be towed. An eye-hook 20 is affixed to the apex of the towing tongue 14 and is adapted to either secure the device 10 to the tractor unit or to receive structures useful for spreading and directing the electrical cables during dispensing operations.

Rotatably affixed to the frame 12 are dual drive wheels 22 supported by axles 24. The suspension consists of walking beams (not shown) attached to the trailer frame 12 by means of leaf springs (not shown) providing capabilities of controlling the arc movement of the walking beam in relation to the terrain on which the device 10 is to be used. The wheels 22 are spaced apart to facilitate the selective entry of a drive wheel mechanism useful to occasion forward, backward or circular movement of the device 10. The details and operation of the drive wheel mechanism will be described hereinafter. Braking of the device 10 is accomplished with an air-over hydraulic system. A braking system is provided for the device 10 when it is operated independent of the pulling vehicle or truck by a stored air supply carried within the trailer framework.

Slidably engaged with the rear of the frame 12 and disposed within spaced apart housings 30 are mounts 32 which have locking assemblies useful to maintain the mounts 32 either in the raised position or against the terrain while cable dispensing operations are being performed. These mounts 32 may be hydraulically operated; however, in the preferred embodiment they consist of substantially square steel tubes having a plurality of apertures defined therein and adapted to receive a locking element (not shown) for maintaining the mounts 32 in their operative state within the housings 30.

Extending upwardly from the frame 12 is an A-shaped reel support structure 40 which at its apex defines a platform 42. Rigidly secured to the platform 42 is a mount 44 which is adapted to receive a mandrel 46 used to support one or more cable reels from which the electric cable will be dispensed. The mount 44 has outwardly extending flanges 48 for assisting in receiving the mandrel 46 when loading cable reels onto the cable dispensing device 10. Although in the preferred embodiment the mount 44 is shown to consist of an internal U-shaped channel, it should be understood that bearings (not shown) may be added to the mount 44 to facilitate easier rotation of the reels during cable dispensing operations.

A cross-brace member 50 is disposed between and welded to the angled sides of the support structure 40 and is useful to increase the strength of the structure 40 and provide a locus for the attachment of other drive assemblies used with the cable dispensing device 10. A hydraulic drive cylinder 52 fitted between the platform 42 and the cross-brace member 50 is supplied by hydraulic lines 54 which in the preferred embodiment are threaded through the hollow portions of the support structure 40 and extend to a control panel. A piston 56 is adapted to reciprocate in response to the introduction of hydraulic pressure into the cylinders 52 which are of the double-acting single end rod variety.

The piston 56 has a drive housing 60 rigidly affixed to its outwardly extending end, which is operative to maintain the assemblies useful to facilitate forward, backward or circular movement of the cable dispensing device 10. Drive housing 60 has a hydraulic motor 62 mounted rigidly in its uppermost section shown in phantom in FIG. 1. The hydraulic motor 62 has an outwardly extending drive shaft 64 which is adapted to drive a first sprocket 66. A drive chain 68 is cooperatively engaged with the first sprocket 66 and a second sprocket 70, which is secured to a shaft 72. Rotation of the shaft 72 in accordance with movement of the sprocket 70 will cause rotation of a plastic pilot wheel 74 selectively fitted between the drive wheels 22, thus occasioning movement of the drive wheels 22 and the device 10. The hydraulic motor 62 is bidirectional and is operated by the introduction of hydraulic pressure through lines 76 which are similarly threaded through the A-frame support structure 40 to the control panel.

As stated previously, the opposite sides of the cable dispensing device 10 are in many respects substantially similar; therefore, it should be understood that there is a first side drive cylinder 52, a first side drive housing 60 and associated elements, a second side drive cylinder (not shown), and a second side drive housing (not shown) and associated elements. Similarly, for the purposes of this application, there are first side tandem drive wheels 22 and second side tandem drive wheels (not shown). In FIG. 1, the first side on the device is illustrated. By selectively innervating the first or second side drive housings, the device 10 may move in either a forward, rear or circular manner.

Disposed along the forwardmost portion of the frame 12, a nose wheel casing 80 surrounds a single end-rod double-acting hydraulic cylinder 82. The cylinder 82 is operated by the introduction of hydraulic pressure through lines 84, which supply occasions selective outward or inward movement of a piston 86. Affixed to the lowemost portion of the piston 86 is a nose wheel assembly 88 adapted to support the front end of the cable dispensing device 10. When the nose wheel assembly 88 has been lowered to contact the ground, the device 10 is placed in a 3-point suspension. This 3-point suspension stablizes and facilitates greater maneuverability of the device 10.

Also located in the forwardmost portion of the frame 12, and drawn partially in phantom in FIG. 1, is a conventional gas-powered engine 90 and associated unidirectional, pressure-compensated hydraulic pump (not shown) for supplying the desired hydraulic pressure to the system. In the preferred endowment, the device 10 is provided with a power pack consisting of a 16 HP Briggs and Stratton air-cooled gasoline engine, 3,000 RPM, coupled to a hydraulic Parker piston pump. The hydraulic pump is provided with standard pressure controls, flow controls and relief mechanisms to facilitate safe utilization of the cable dispensing device. The engine 90 is also provided with horsepower limiting means to avoid the possibility of peak pressures being developed within the hydraulic system.

As indicated previously, the frame 12 and support structure 40 are preferably made of hollow steel tubing. This is desirable for two reasons. Principally, the use of hollow tubing substantially lessens the weight of the cable dispensing device 10. Second, the hydraulic lines may be threaded through the hollow tubing to protect them from inadvertant impacts which may cause severe damage. Similarly, the hollow tubing may be used as reservoirs for hydraulic fluid or other lubricants as will be described hereinafter. Appropriate fittings may also be installed within the frame structure 12 to facilitate the application of air pressure to the hollow tubing to assist in the application of lubricants to the cable while being dispensed.

Figure 2:
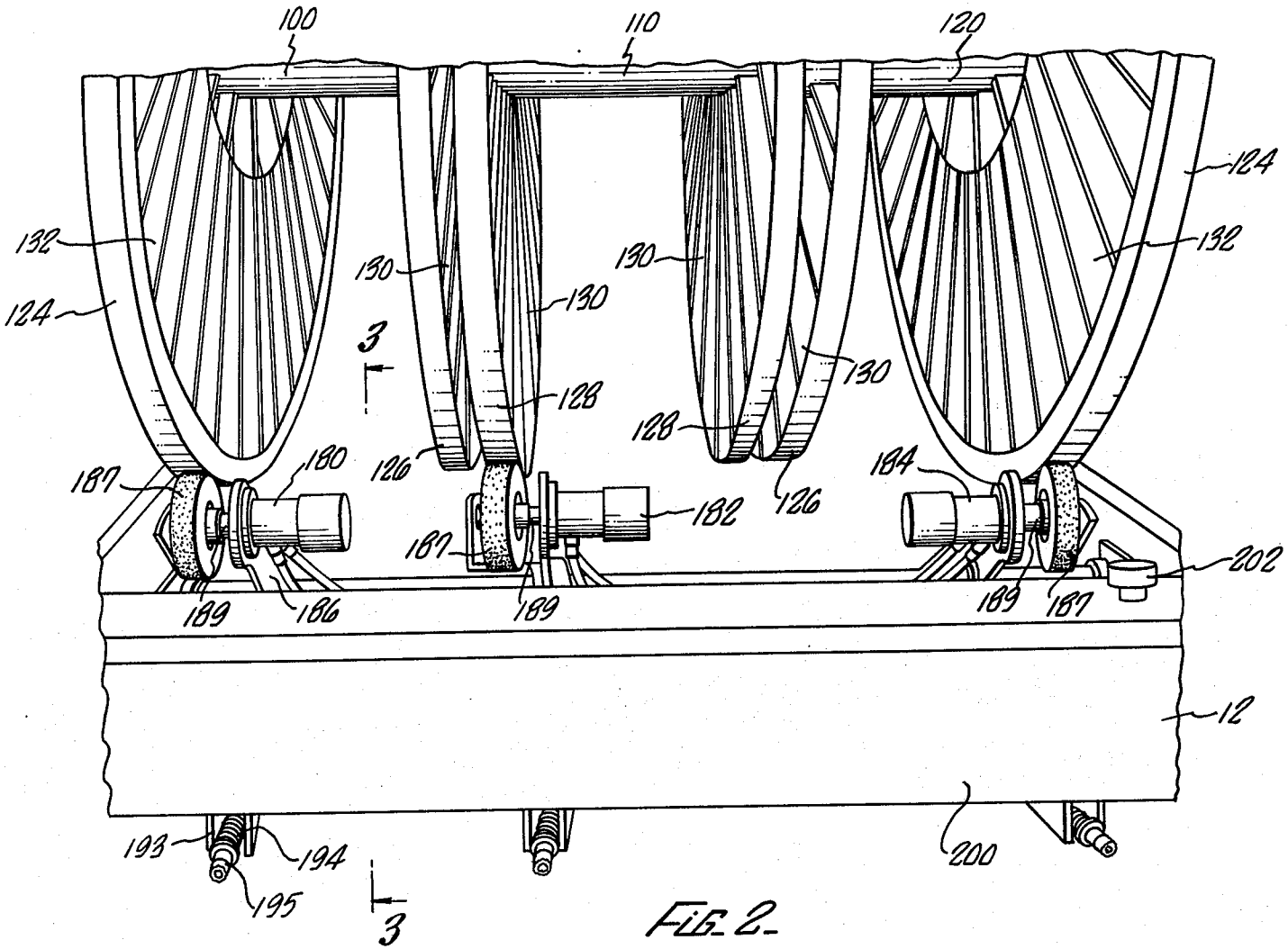
FIG. 2 is a rear elevation view of a portion of the cable dispensing device taken on line 2—2 of FIG. 1 illustrating the position of the hydraulic motors and cable reel driving mechanism.

As shown in FIGS. 1 and 2, the cable dispensing device 10 is adapted to support a plurality of side-by-side reels 100, 110, 120, which have wound thereabout the conductor cables C to be dispensed into the underground duct system. The conductor cable C is of the standard variety for use in high-voltage systems and is generally stiff and of limited flexibility. It should be noted that although the cable dispensing device 10 is shown with three reels 100, 110, 120, it is also useful in dispensing cable from one reel or two reels. When used for the aforementioned purpose, it is necessary to provide a locking means upon the mandrel 46 to retain the reels in a defined area upon the mandrel 46.

Each reel 100, 110, 120 is composed of a hollow core section 122 and a pair of rims. As shown in FIG. 2, each of the end reels 100, 120 has an end rim 124 and an internal rim 126. The middle reel 110 has two rims 128 of substantially the same diameter. The rims 128 of the middle reel 110 and the inside rims 126 of the end reels 100, 120 may be supported by a plurality of radially disposed spokes 130 constructed in the preferred embodiment of square tubing. The end rims 124 of the reels 100, 120 are supported by ribbed flanges 132. Other cross-structures may be added to the sides of the reels to obtain greater radial strength. The reels 100, 110, 120 are supported upon the mandrel 46 to facilitate rotation in either direction. It should be noted that other designs of the reels are within the skill of the art and scope of the invention.

The diameter of the rims 124 of the end reels 100, 120 is preferably slightly larger than the diameter of the internal rims 126 or the rims 128 of the middle reel 110. It should also be noted that these rims 124, 126, 128 may be provided with a plurality of flat sections (not shown) to prevent the reels 100, 110, 120 from uncontrolled rolling when being stored on end at warehouse facilities. Additionally, these reels 100, 110, 120 may develop dents or flat sections along their rims due to wear. The cable dispensing device 10 has means associated therewith for receiving these reels having flat sections along their rims and dispensing cable therefrom without reducing the efficiency of the cable dispensing operations.

Each reel 100, 110, 120 is mounted on the mandrel 46 and rotably secured in its position by a pair of roller bearings (not shown). The reels 100, 110, 120 are mounted side by side adjacent to each other in close proximity to minimize the width of the cable dispensing device 10. Although each of the reels 100, 110, 120 is mounted and permitted to rotate independent of each other, the proximity of the reels 100, 110, 120 also facilitates their interlocking and combined rotation for use when loading the reels with cable.

It is particularly important that the reels 100, 110, 120 be able to rotate independent of each other when the cables C are being pulled around 90-degree bends or long curves wherein the position of the cables within the underground conduit will necessitate that certain of the cables C be pulled greater distances than other cables C.

A means is also provided for affixing the cable ends (not shown) to the reels 100, 110, 120 and this means comprises a channel bored through a secant section of the core 122 of each reel. The channel is adapted to receive the cable C and retain it substantially immovably by a locking means (not shown). The method and apparatus for receiving these cables within the core 122 of each reel and for affixing them securely therein is described in pending U.S. patent application Ser. No. 154,609, filed on May 30, 1980, the disclosure of which is incorporated herein by reference.

Figure 5:
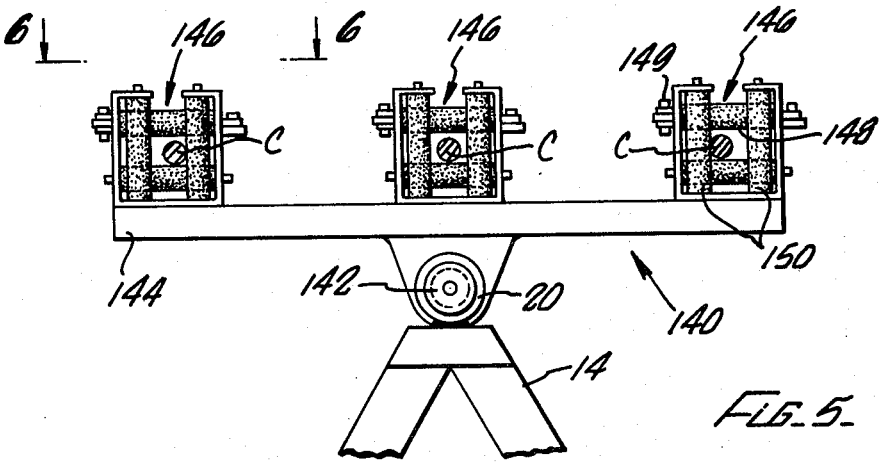
FIG. 5 is a front elevation of a spreader bar useful to prevent the cables from touching the cable reel rims as they are dispensed from the reels.
Figure 6:
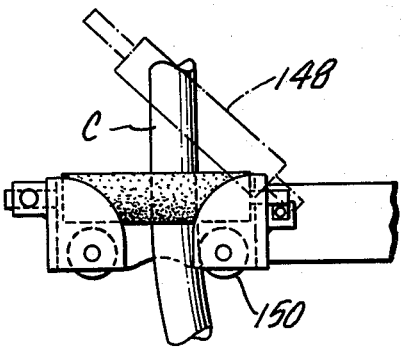
FIG. 6 is a side elevation of one member of the spreader bar of FIG. 5 as it pivots to receive and guide one cable.
Figure 4:
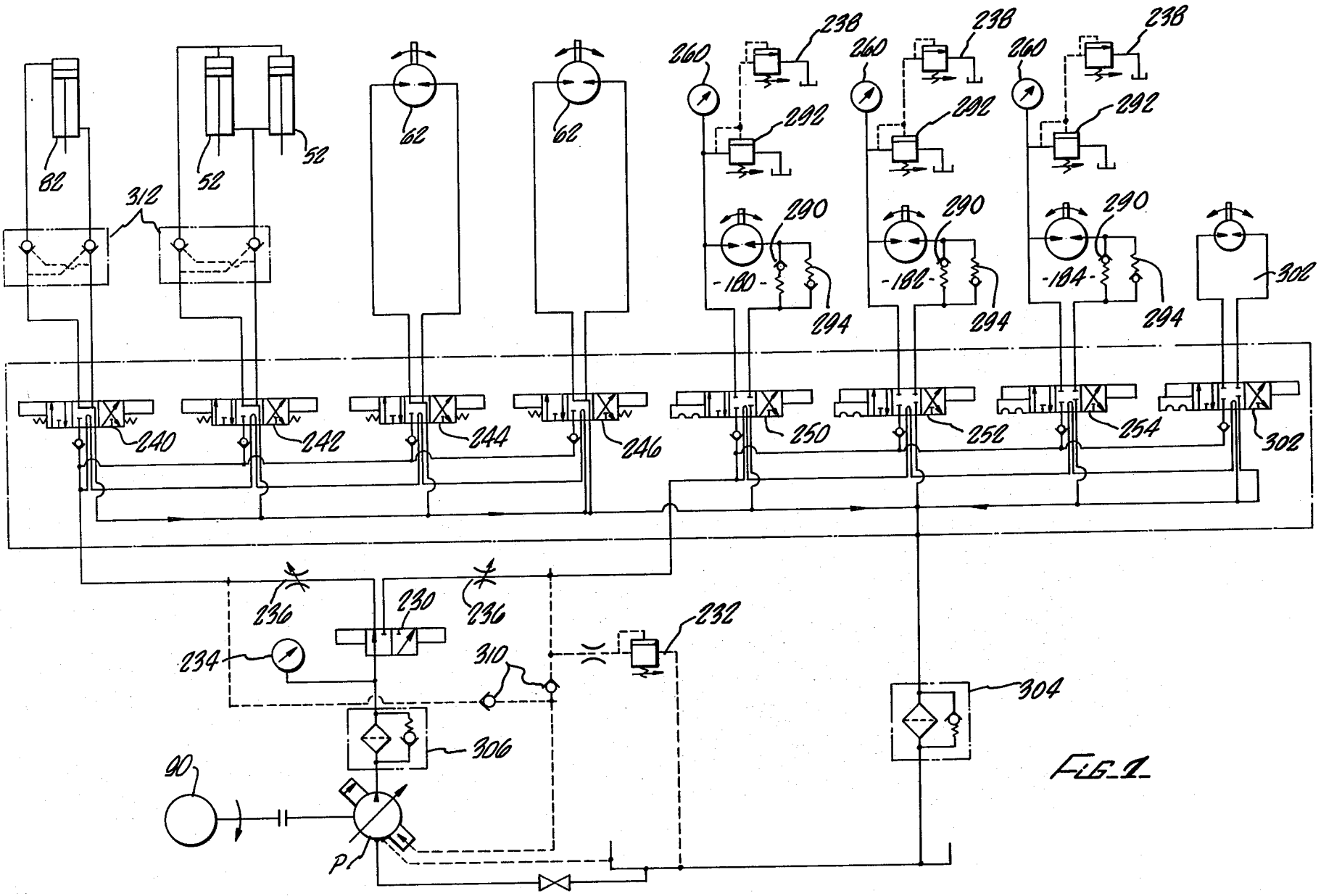

As shown in FIGS. 1, 5, and 6, a spreader bar 140 is adapted to be received and held rigidly by the eye hook 20. The spreader bar 140 is provided with a locking element 142 for securing it to the frame 12 when not being used with the towing tongue 14 in the dispensing mode. A pin (not shown) is receivable into the aperture 18 located within the pivot section 16 and is useful with the towing tonque 14 to define an inclined angle between the tonque and the frame 12 when using the spreader bar 140 during cable dispensing operations.

In FIG. 5, the spreader bar 140 is shown in its operative position affixed to the towing tongue 14. A pivotable platform 144 provides support for a plurality of 4-way roller systems 146 which are adapted to separate the cables C and direct them to the cable laying guide as described hereinafter. The pivotal movement of the towing tongue 14 and spreader bar 140 is useful in guiding the cables C in an arcuate path from the reels 100, 110, 120 to the cable guide.

As shown in FIGS. 5 and 6, the rollers 148 are pivotable in relation to the rollers 150 to accommodate loading of the cable C before commencement of cable dispensing operation. A locking means 149 is useful to maintain the rollers 148 attached next to the rollers 150 after the cables C have been loaded into the 4-way roller systems 146. Thus, the spreader bar 140 prevents the cables C and the concentric wire wrapped about the cables C from touching the reel rims 124, 126, 128.

After the cables C have been loaded within the 4-way roller systems 146 of the spreader bar 140, they are receivable into a cable guide 160 as shown in FIG. 1. The cable guide 160 is useful in simultaneously dispensing a plurality of cables C into an underground duct system. In the preferred embodiment, the cable guide 160 comprises a feed bell 162 and underground duct segment 164 in coaxial alignment thereith. A suspension platform (not shown) may be provided to support the cable guide 160 at a predetermined angle with respect to the underground duct system. A rope means 166 or other similar structure is useful in suspending the cable guide 160 from the suspension platform.

Cable dispensing through the use of a cable guide 160 is best described in application Ser. No. 124,132, filed Feb. 25, 1980, now U.S. Pat. No. 4,331,322 which is incorporated herein by reference. It should be noted that other cable guide means (not shown) may be used with the cable dispensing device 10 of the present invention without departing from the spirit or scope of the invention.

Figure 3:
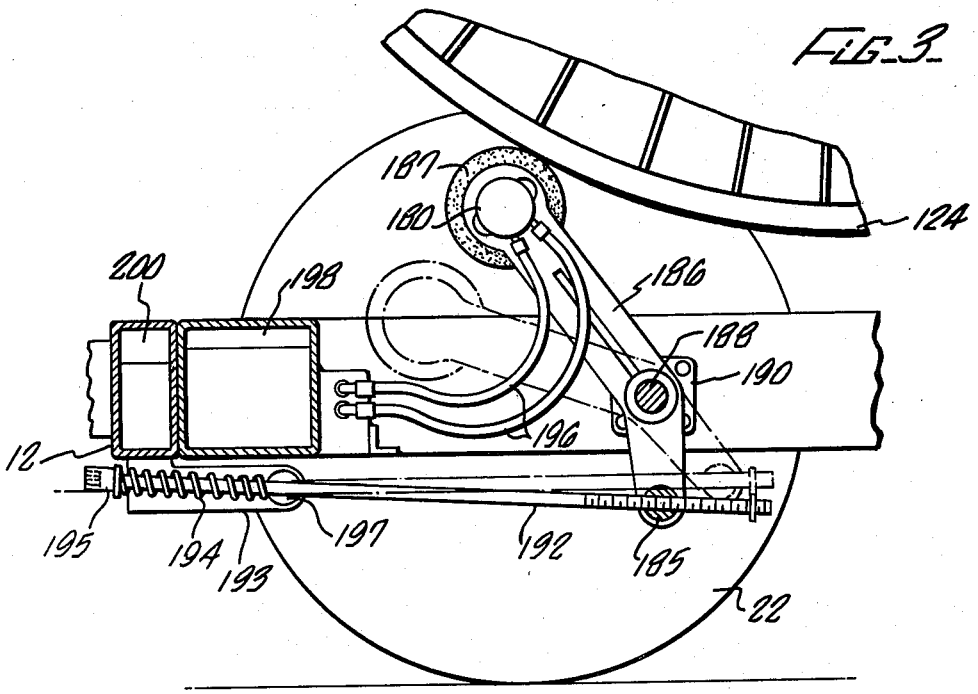
FIG. 3 is a side view taken on line 3—3 of FIG. 1 illustrating one of the cable reel driving mechanisms and its biased engagement with the associated rim of the cable reel.

With reference to FIGS. 2 and 3, a plurality of bidirectional hydraulic motors 180, 182, 184 are adapted to provide positive force to the cable reels 100, 110, 120 respectively to decrease pulling tension applied to the cables C while being dispensed. Since in this preferred embodiment all three hydraulic motors 180, 182, 184 are identical in form and operation and they only vary with respect to their position in relation to the frame 12, only one of the hydraulic motors will be described in great detail and it should be understood that the other motors 182,184 are operative in the same manner.

As shown in FIG. 3, the hydraulic motor 180 is supported by a bell crank 186 which is pivotably secured to a cross-bar 188 disposed between opposite sides of the frame 12 and supported by brackets 190. Referring to FIG. 2, a rubber-tired wheel 187 is fixedly secured to drive shaft 189 extending outwardly from the motor 180. The rubber-tired wheel 187 is designed to contact the rims 124 and 128 of the cable reels 100, 110, 120, thereby providing a positive drive force during cable dispensing operations. As will be readily appreciated by those skilled in the art, a variety of frictional wheel means or drive means may be employed in place of a rubber-tired wheel.

As best shown in FIG. 3, opposite the motor 180 and cooperatively engaged with the bell crank 186 is an acme threaded bolt 192 which is receivable into the bell crank 186 at a rotatable axle 185 having an aperture defined substantially in the center thereof. The threaded bolt 192 is operative to adjust the position of the rubber-tired wheel 187 with respect to the rim 124 or 128. The bolt 192 is maintained within a housing 193 and has a spring 194 wound thereabout useful to bias the bell crank 186 to the raised position wherein the rubber-tired wheel 187 is in continuous contact with the rim 124 or 128. Lastly, as shown in FIG. 3, a stub axle 197 is operative with the housing 193 to maintain the bolt 192 biased by the spring 194 within housing 193. The spring 194 serves to maintain the rubber-tired wheel 187 in contact with rim 124 or 128 during the cable pulling operation regardless of the presence of flat sections (not shown) or irregularities on the periphery of the reel rims.

By rotating an adjustment fitting 195 it is possible to vary the position of the threaded bolt 192 with respect to the bell crank 186 thereby making it possible to receive and positively drive a wide range of cable reels having different diameters. This particular feature may be required to dispense cables of varying diameters and lengths. The variable positioning of the rubber-tired wheel 187 with respect to the rim 124 is illustrated in FIG. 3 in phantom.

Dual hydraulic lines 196 are flexibly connected to the hydraulic motor 180 to facilitate supplying of the hydraulic motor 180 with hydraulic fluid regardless of the orientation of the bell crank 186.

Also shown in FIG. 3 is a hydraulic fluid reservoir 198 disposed inside the frame 12 and operative to supply hydraulic fluid to the control system described herein. Similarly, within the frame 12 a lubricant reservoir 200 is provided to facilitate the application of the lubricant to the cables during cable dispensing operations. As illustrated in FIG. 2, an air valve 202 is fitted to the lubricant reservoir 200, thus permitting the lubricant in the reservoir 200 to be pressurized and injected into the cable guide 160 during the course of cable-laying operations.

Figure 4:
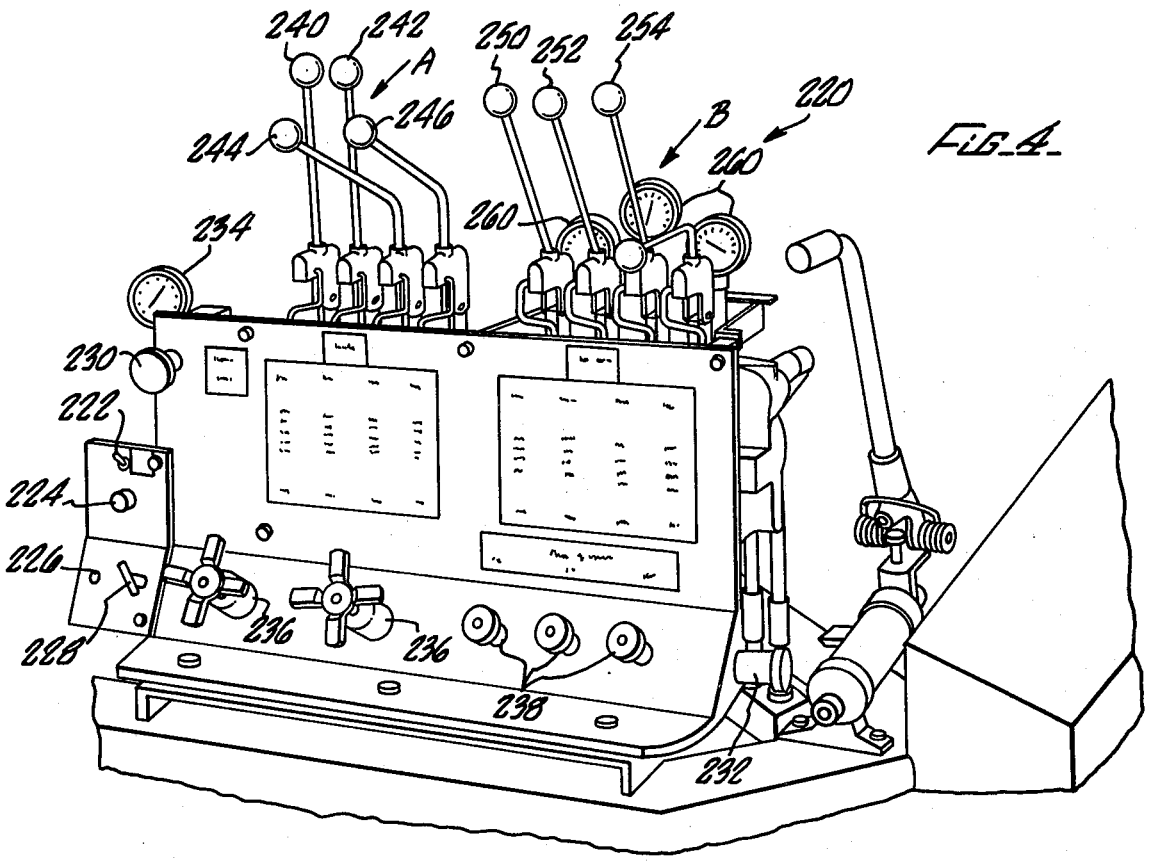
FIG. 4 is a close-up view of the cable dispensing control panel illustrating the orientation of the separate banks operative to control the hydraulic pressure supplied to the hydraulic drive motors.

With reference to FIG. 1, a control panel 220 is located in the forwardmost section of the cable dispensing device 10 and is operative to regulate and monitor the cable dispensing operation. Briefly, and as shown in FIG. 4, the control panel 220 has a conventional on-off toggle switch 222 and starter button 224. A choke 226 and rotatable throttle 228 are disposed below the starter button 224 and are adapted to increase or decrease the power generated by the gas powered engine 90. As indicated previously, upon activation of the gas-powered engine 90 the hydraulic pumping elements (not shown) begin to supply pressurized hydraulic fluid to the system.

The control panel 220 is separated into two sections, called banks A and B, which each have hydraulic control circuitry provided therewith. Operative to select which bank A or B shall be used is a hydraulic cross valve 230 which has an inward/outward movement, thereby exclusively innervating either of the banks A or B. It is desirable to make the banks A and B operative exclusive of each other as a safety device. When using the control panel 220 to operate the bidirectional hydraulic motors providing positive drive to the cable reels, it is desirable that the cable dispensing device 10 be substantially stationary. By only permitting the innervation of one bank A or B, it is only possible to either move the device 10 or apply a positive drive torque to the cable reels 100, 110, 120.

A pressure control valve 232 is provided to define the maximum hydraulic pressure supplied to the Banks A or B of the hydraulic system. A pressure gauge 234 is in fluid communication with the pressure control valve 232 and is adapted to inform the operator of the hydraulic pressure in the Banks A or B. Suitable relief mechanisms well known to those skilled in the art are also provided to reduce the possibility of overpressure within the hydraulic system.

Dual flow control needle valves 236 are also included with the control panel 220 to regulate the volume of hydraulic fluid sent to each of the banks A or B. A variable pressure control valve 238 is provided within the hydraulic circuitry for each one of the motors 180, 182, 184 which drive the reels 100, 110, 120 of the cable dispensing device 10.

Operative with Bank A are four normally closed, two-way, pre-set, controllable pressure valves 240, 242, 244, 246 which provide on/off operation for the hydraulic motors and cylinders as will be described hereinafter. The valves 240, 242, 244, 246 must be held in position by the operator or else they will return to the neutral position. Pressure valve 240 is utilizable to actuate the nose wheel cylinder 82, thereby occasioning downward or upward movement of the nose wheel assembly 88 upon command. The pressure valve 242 is operative with the drive cylinders 52 to either cause the drive wheel assemblies 60 to attain a position between each pair of tandem drive wheels 22 or to attain their removed position wherein the pilot wheels 74 are not disposed between the pairs of tandem drive wheels 22.

Upon actuation of the valve 242 the pilot wheels 74 are positioned between the pairs of tandem drive wheels 22. By then operating in an upward or downward manner the pressure valves 244 or 246, either independently of one another or together, either the right side or left side tandem drive wheels 22 will rotate, thereby facilitating forward, rearward or circular movement of the cable dispensing device 10.

Operative with bank B are three pre-set, normally closed, two-way, controllable pressure valves 250, 252, 254 which are operative to direct hydraulic pressure into the hydraulic motors 180, 182, 184 to apply a positive drive force to the cable reels during cable dispensing operations. The two-way pressure valves 250, 252, 254 are adapted to provide forward or reverse rotation of the hydraulic motors 180, 182, 184. These valves 250, 252, 254 will remain locked in the position selected by the operator.

The application of hydraulic pressure to the hydraulic motors 180, 182, 184 by depressing or lifting the valves 250, 252, 254 will cause a positive driving torque to be applied to the cable reels. During the cable pulling operations the rubber-tired wheels 187 will rotate and apply a driving force to the reels 100, 110, 120, thus decreasing the pulling tension on the cables C being drawn into the underground duct. Similarly, the bidirectional hydraulic motors 180, 182, 184 may be used to cause the reels 100, 110, 120 to rotate in the opposite direction to facilitate cable take-up or loading. A plurality of pressure gauges 260 are in fluid communication with the hydraulic pressure lines emanating from the control valves 238. These gauges 260 inform the operator of the hydraulic pressure being supplied to the hydraulic motors 180, 182, 184.

The hydraulic power and control system of cable dispensing device 10 is schematically represented in FIG. 7. Briefly, the gas-powered engine 90 is operative to supply power to the hydraulic pump P. The bank selector cross-valve 230 is then utilized to determine which of the banks A or B are to be innervated. The flow control valve 232 is operative to define the maximum level of hydraulic pressure which may be supplied to either of the banks A or B. By setting the valve 232 to a desired value, if the pressure within the lines associated with either bank A or B exceeds a certain value, then standard relief mechanisms will be activated.

The flow control needle valves 236 are then adjusted to determine the volume of hydraulic fluid sent to either of the banks A or B. Thus, the speed to the system is controlled by the opening and closing of these flow control needle valves 236.

As indicated previously, a pressure control valve 238 is provided for each of the hydraulic motors 180, 182, 184. By adjusting the valves 238 it is possible to independently regulate the hydraulic pressure sent to each motor 180, 182, 184.

With each hydraulic reel drive motor 180, 182, 184 a 5 psi directional check valve 290 has been placed from the hydraulic line going into the hydraulic motors. These check valves 290 are provided to permit the hydraulic fluid to move when the motors 180, 182, 184 are in a reversed mode which would be used when winding cable onto the reels 100, 110, 120.

Each hydraulic motor 180, 182, 184 also has an preset pressure valve 292 which defines the maximum pressure permitted into the hydraulic lines going to hydraulic motors.

Because of the ease with which the cable reels 100, 110, 120 turn, a braking action is necessary to prevent the reels 100, 110, 120 from overriding when pulling action ceases. This is provided by placing a 275 psi pressure directional valve 294 in the hydraulic return of each motor 180, 182, 184. It should be noted that when originally adjusting the valves 238 it is necessary to admit a pressure in excess of 275 psi to initiate pressure being sent to the motors 180, 182, 184. Thus, when cable-pulling tension ceases to exist the operator may place the valves 250, 252, 254 in the closed position and the motors 180, 182, 184 will act as energy dissipators of the cable reel rotational inertia.

An auxiliary pre-set, normally open, two-way controllable pressure valve 300 is provided on the control panel 220 and is operative to control the application of hydraulic pressure to an auxiliary hydraulic motor 302.

All of the hydraulic lines within the system feed into a return line filter 304 before the hydraulic fluid is returned to the pump P. Also provided is a pressure filter 306 for the fluid as it leaves the pump P. Lastly, two check valves 310 are provided to prevent flow from moving the wrong direction in the hydraulic control system.

As indicated previously, the hydraulic motors 180, 182, 184 are adapted to rotate in either a clockwise or counterclockwise manner, thus facilitating either the dispensing or take-up of cable. Similarly, the motors 180, 182, 184 are also operative to provide a braking action to the reels in the event that an imbalance is perceived between cable pulling and cable payout. Although not shown in FIG. 1, a hand braking means may be provided to completely cease rotation of the reels 100, 110, 120 if the operator observes a slack developing in the cables C. Attached hereto as Exhibit A is a parts list of components used to construct the preferred embodiment.

In operating the cable dispensing device 10 of the present invention, the device 10 is first loaded with the cable reels 100, 110, 120 by disposing the mandrel 46 having the reels located thereon within the opposing mounts 44. The reels 100, 110, 120 if unloaded may be engaged as indicated previously and loaded with cables C by occasioning their combined rotation. Cable is then drawn from the reels 100, 110, 120 and a pulling head (not shown) is formed.

The device 10 is then towed to the proper location by a tractor unit (not shown). Upon arriving at the job location, the deviced 10 should be placed into position so the cable C will be pulled from the front end of the device 10. The reasons for this positioning are as follows: All controls for operation of the device 10 are mounted in a position so as to provide the operator with an unobstructed view of where the device 10 is going when it is desirable to move this vehicle. It affords excellent vision of the cables C as they are pulled from the reels and through the roller systems 146, which prevent the concentric wire on the cable from making contact with the rims 124, 126, 128 of the cable reels. It also provides the seated operator the ability to observe the cables C as they are being pulled into the underground duct system. It is from this vantage point the operator will be able to determine the status of the moving cable, thus providing him with visible information as to when to brake the moving cable. These braking devices are placed in proximity of the operator on the front end of the device 10.

Upon reaching the location wherein cables are to be dispensed, the operator positions the device 10 properly with respect to the underground duct system by selecting Bank A and actuating the drive wheel assemblies 60. This is accomplished by actuating the pressure valve 242, thereby innervating the drive wheel cylinders 52. By then alternately or concurrently activating the hydraulic motors 62 by moving the pressure valves 244 or 246 in either an upward or downward movement, the device 10 may be positioned for cable dispensing operations. During movement of the device 10 or once the device 10 is in the proper position, the nose wheel assembly 88 may be lowered into position by actuating the pressure valve 240. After the device 10 is in the proper location and the nose wheel assembly 88 has been lowered the rear mounts 32 may then be positioned to stabilize the device 10 on the terrain.

The spreader bar 140 may then be removed from the frame 12 and attached to the towing tongue 14. A pin (not shown) is then placed through the apertures 18 found on the towing tongue 14 to define the position of the spreader bar 140 during the course of cable dispensing operations. The rotatable rollers 148 associated with the 4-way roller systems 146 are then pivoted to permit the cables C to be placed within the roller systems 146. After the cables C have been loaded atop the spreader bar 140 the rollers 148 are then rotated back to their original position and locked, thereby encasing the cables C within the roller systems 146. After a sufficient amount of cable has been drawn off the reels 100, 110, 120 to pass through the spreader bar 140 the cables C are then combined to form a pulling head (not shown) which is attached to a pulling rope. The ends of the cables C attached to the pulling head are surrounded by tape or other mastic material which is adapted to maintain them in a fixed configuration. The pulling rope has been drawn through the underground duct system before being attached to the pulling head. The cables C are then positioned within the cable guide as described in copending application Ser. No. 124,132, now U.S. Pat. No. 4,331,322 which has been incorporated herein by reference.

After the device 10 has been correctly positioned and the cables C loaded within the cable guide, the operator is provided with two techniques he can use for the installation of cable from the device 10. The first is the free-wheeling technique and the second consists of applying a torque to the cable reels. When using the free-wheeling method, the operator adjusts the fitting 195 and lowers the rubber-tired wheels 187 into a position where they no longer make contact with the reel rims 124, 128. Therefore, the movement of the cable reels 100, 110, 120, when cable-pulling movement ceases, is entirely controlled by application of the handbrake (not shown), which applies the braking action to each reel rim 124, 128.

When using the second technique which applies a turning torque to the rims 124, 128 of the cable reels 100, 110, 120 the operator first selects bank B and adjusts the maximum flow of hydraulic fluid passing into the bank B by rotating the pressure control valve 232. The operator also adjusts the valves 292 to set the maximum hydraulic pressure which can be applied to each of the hydraulic motors 180, 182, 184. The threaded bolts 192 may then be adjusted to assure the operator that the rubber-tired wheels 187 are in contact with the reel rims 124, 128.

With the pressure valves 250, 252, 254 set to the forward open position, the operator may begin to manipulate the controllable pressure valves 238 to admit hydraulic pressure to the motors 180, 182, 184 to facilitate the application of a positive torque on the cable reels 100, 110, 120. As indicated previously the 275 psi hydrostatic head must first be overcome by turning the valves 238 to permit hydraulic pressure in excess of 275 psi. When the reels 100, 110, 120 are at rest, the pressure control valves 238 are turned until the torque applied by the motors 180, 182, 184 is just below that required to overcome the static friction of the cable reels 100, 110, 120. The proper setting is just below that when the rubber tired wheels 187 slip against its cable reel rims 124, 128 while the cable reels 100, 110, 120 remain at rest.

As the cable reels, 100, 110, 120 begin to turn from the application of a pulling force from the pulling end, the hydraulic motors 180, 182, 184 will turn the rubber-tired wheels 187 in contact with the cable reel rims 124, 128. This is only accomplished when the preset pressure control valves 250, 252, 254 are in the position associated with forward movement of the cable reels. This operation provides a driving force to the cable reel rims 124, 128 as long as the cable is being pulled at the pulling end. The flow control needle valves 236 may also be adjusted to increase the hydraulic fluid flow to occasion greater speed in the system.

If during the course of cable dispensing operations, the synchronization between the pulling end and the payout of cables C becomes out of phase, thus causing slack in the cables C disposed thru the spreader bar 140, the operator only has to change the pressure control valves 238, thus regulating the torque applied by the hydraulic motors 180, 182, 184 to the wheels 187. Similarily as cable is used the weight of the cable reels 100, 110, 120 becomes less and therefore less torque is required to turn the reels. If too much torque is applied, the rubber-tired wheels 187 will begin to move faster than the reel rims 124, 128, thus causing a slippage. Upon visually observing of this condition, the operator will be able to lower the pressure supplied to the hydraulic motors 180, 182, 184, thereby once again reestablishing a balance between the rotation of the cable dispensing reels 100, 110, 120 and the pulling mechanism (not shown).

Because of the independent control achieved with the valves 238, the payout of cable from each reel 100, 110, 120 may be varied in accordance with the pulling tension on each cable C. It should be noted that the method and apparatus disclosed herein for dispensing cable may be used with equal efficiency with single or dual reels without modifying the equipment.

When the pulling operation is completed or interrupted, the rotation of the reels 100, 110, 120 is resisted by the use of check valves 294 which hinder the flow of hydraulic fluid from the motors 180, 182, 184 and impart up to 275 psi of pressure upon the discharge of the hydraulic motors 180, 182, 184. Thus, by setting the valves 250, 252, 254 in the closed position braking force is applied to the reels 100, 110, 120. The hydraulic flow control valves 236, which control the speed of the motors 180, 182, 184 driving the reels 100, 110, 120 can be turned off when the operator observes the cable C is no longer under pulling tension, thereby creating an even greater braking action on the cable reels 100, 110, 120. This system is of considerable benefit in helping to dissipate the momentum of the reels 100, 110, 120 which may be turning at speeds on the order of 12 r.p.m. during the cable dispension operation.

By using the cable dispensing device and method of the present invention for simultaneously dispensing three cables into an underground duct, many of the problems associated with laying triplex cable have been eliminated. For example, there is substantially less cable wastage, and additional costs incurred in triplexing cable are not experienced. Another substantial advantage of the present system is the reduced possibility of line discontinuities occasioned by strains acting upon the cables C during the pulling operation.

Even with the assistance of lubricants applied to the cables C via the cable guide, there still remains a great strain on the cable lengths as they are being pulled through the underground duct system. By combining the lubricating systems and advantages of a cable guide as described in U.S. patent application Ser. No. 124,132, now U.S. Pat. No. 4,331,322 with the presence of an unwinding torque to the cable reels, as disclosed herein, substantial improvements are possible and increased efficiency is achieved in cable dispensing techniques.

By utilizing a three independent conductor type of system, less space is required to wind the conductor on a reel and therefore more cable can be placed on the reel. Since more cable can be placed on a reel, much longer lengths can be carried on the trucks utilizing public highways. Other substantial advantages accrue as a result of the increased reliability due to the possibility of laying larger homogenous lengths of cable within the underground duct system. Previously, due to the problems incurred in laying triplex cable, a plurality of splicing vaults were necessarily built to provide areas wherein the cable sections could be spliced. These splicing vaults are expensive and served as areas with substantial insulation problems. With the present invention longer lengths of cable can be placed in underground duct systems, thereby reducing the number of splicing vaults that are needed.

The present device is also useful in dispensing cables of different sizes which may be wound about reels of different sizes. Independent rotation of the reels facilitates a wide range of cable dispensing capability.

Although the present invention has been described in considerable detail, with reference to the preferred embodiment thereof, other modifications are also possible. Therefore, the invention is not to be limited to the description contained herein but rather is defined by the scope and spirit of the appended claims.

| REFERENCE NUMERAL | | |
|---|---|---|
| 1. 62, 180, 182, 184 | 5 ea. | 104–1026 Char-Lynn motor |
| 2. 230 | 1 ea. | SVS-4 Cross valve |
| 3. 232, 238 | 4 ea. | RCP400SH Parker valve |
| 4. 234 | 1 ea. | G251GL Enerpac gauge |
| 5. 236 | 2 ea. | MV1200S Parker needle valve |
| 6. 304 | 1 ea. | 1L2-1-10C-MP-25-YDYD1 Parker return filter |
| 7. 306 | 1 ea. | 25P10CM50NN1 Parker Pressure filter |
| 8. 310 | 2 ea. | C400S Parker check valve |
| 9. 312 | 2 ea. | VCPD6P1T Parker valve |
| 10. P | 1 ea. | PAVC33$C Parker Piston Pump - 1. 2900 RO, drive speed max. 2. 2500 PSI dead head setting 3. 14 H.P. (limited) 4. 23.8 (actual) GP, at 2900 RPM |

I claim:

1. A self-propelled, cable dispensing dolly comprising:

(a) a frame having a front, a rear, and two sides, (b) on the frame means for rotatably supporting at least three cable reels side-by-side, each cable reel having two opposing rims and a core section disposed therebetween, the supporting means allowing the reels to rotate independently;

(c) independent driving means operably communicating with each supported reel, and means for controlling the driving means to selectively apply a driving torque to each cable reel to cause rotation in a first direction of rotation to unwind cable from each cable reel or to selectively apply a driving torque to each cable reel to cause rotation in a second direction of rotation to wind cable onto each cable reel;

(d) a control means operable with each of the driving means for adjusting the torque applied to each cable reel independent of the torque applied to any other cable reel;

(e) a first pair of wheels comprising a front wheel and a rear wheel on one side of the frame and a second pair of wheels comprising another front wheel and another rear wheel on the other side of the frame; and (f) first rotating means for rotating the first pair of wheels forward or backwards and second rotating means for rotating the second pair of wheels forward or backward, the first and second rotating means being independent of each other so that the two pairs of wheels can rotate in the same direction or in opposite directions.

2. The cable dispensing dolly of claim 1, which includes a means operably connected to each drive means for preventing the application of torque to each of the cable reels in excess of that necessary to overcome the static frictional force of each of the cable reels while dispensing cable.

3. The cable dispensing dolly of claim 1, wherein the driving means comprises:

a motor operative with each cable reel supported by the frame, the motor having an output shaft, a drive wheel attached to the output shaft of each motor, the drive wheel of each motor adapted to engage only one of the rims of each of the cable reels, a means for maintaining the drive wheel in contact with the rim of the cable reel.

4. The cable dispensing dolly of claim 3, wherein the maintaining means comprises:

an arm pivotally attached to the frame, the arm having a motor and drive wheel at a first end thereof, biasing means attached to a second end of the arm to cause the drive wheel to contact the reel rim, means for adjusting the biasing means to facilitate substantially continous engagement between the drive wheel and the reel rim.

5. The cable dispensing dolly of claim 1, wherein the control means comprises:

a hydraulic control system operative to supply hydraulic pressure to the driving means, a means for varying the hydraulic pressures supplied to the driving means.

6. The cable dispensing dolly of claim 5, which includes a means for determining the hydraulic pressure supplied to each of the driving means.

7. The cable dispensing dolly of claim 5 which includes a means for setting the maximum pressure that can be supplied to each of the driving means.

8. The cable dispensing dolly of claim 5 which includes a means for setting the maximum hydraulic pressure in th hydraulic control system.

9. The cable dispensing dolly of claim 5 which includes a means for controlling the hydraulic flow in the hydraulic control system.

10. The cable dispensing dolly of claim 1, which includes a means for selectively applying a braking force to each of the cable reels supported by the frame.

11. The cable dispensing dolly of claim 10 wherein each drive means comprises a hydraulic motor and each hydraulic motor has a fluid return line, and the braking force applying means comprises:

a pressure directional valve in the fluid return line to cause the hydraulic motors to dissipate rotational energy from the cable reels.

12. The cable dispensing dolly of claim 1, which includes means for selectively dissipating rotational energy when the reels are rotating in the second direction of rotation.

13. The dolly of claim 1 including a tongue at the front of the frame for towing the dolly, the rear end of the tongue being pivotally connected to the front of the frame so that the front end of the tongue can pivot upwardly, the front end of the tongue having removably attached thereto means for spreading apart unwound cables from the reels.

14. The dolly of claim 1 including means for independently disengaging the first and second rotating means so that both, neither, the first, or the second rotating means engages the wheels.

15. The dolly of claim 1 in which the frame comprises hollow structural elements.

16. The dolly of claim 15 in which the driving means comprises a hydraulic motor and at least one of the hollow structural elements has therein a reservoir for hydraulic fluid.

17. The dolly of claim 15 in which the rotating means comprises a hydraulic motor and at least one of the hollow structural elements has therein a reservoir for hydraulic fluid.

18. The dolly of claim 15 including means for applying lubricant to unwound cables.

19. The dolly of claim 18 in which at least one of the hollow structural elements has therein a reservoir for lubricant.

20. The dolly of claim 1 including a nose wheel and means for raising and lowering the nose wheel so that the front wheels can be raised off and lowered to the ground.

* * * * *